United States Patent [19]

Perretta

[11] Patent Number: 4,919,258

[45] Date of Patent: Apr. 24, 1990

[54] PROTECTIVE CASE FOR A DIVER'S FACE MASK

[76] Inventor: Christine R. Perretta, 3250 NE 5th Dr., Boca Raton, Fla. 33431

[21] Appl. No.: 358,082

[22] Filed: May 30, 1989

[51] Int. Cl.[5] ..... A45C 11/04; B65D 81/02; B65D 85/30

[52] U.S. Cl. ..... 206/5; 206/315.1; D3/34; D3/36

[58] Field of Search ..... 150/154; 206/5, 315.1; D3/33, 34, 36

[56] References Cited

U.S. PATENT DOCUMENTS

| | | | |
|---|---|---|---|
| D. 264,976 | 6/1982 | Greene | 206/5 X |
| 2,650,700 | 9/1953 | Wolf | 206/5 R |
| 3,559,798 | 2/1971 | Jacobsen | 206/5 R |
| 4,287,985 | 9/1981 | Feniger | 206/5 |

*Primary Examiner*—William Price
*Attorney, Agent, or Firm*—John H. Faro

[57] ABSTRACT

A protective case for use with a diver's face mask of the type which includes a glass window, a pliable frame supporting the window around its periphery, and a headband attached to opposite sides of the frame. The protective case comprises: (a) a flat base panel of foam material and (b) a peripheral wall attached to and upstanding from the edge of the base panel and having a contour with the base panel adapted to house the mask without play therebetween. There is (c) a flat cover panel of foam material attached on one side of the peripheral wall with a pair of spaced tethers, and (d) a fastener for detachably attaching the other side of the cover panel to the peripheral wall.

10 Claims, 1 Drawing Sheet

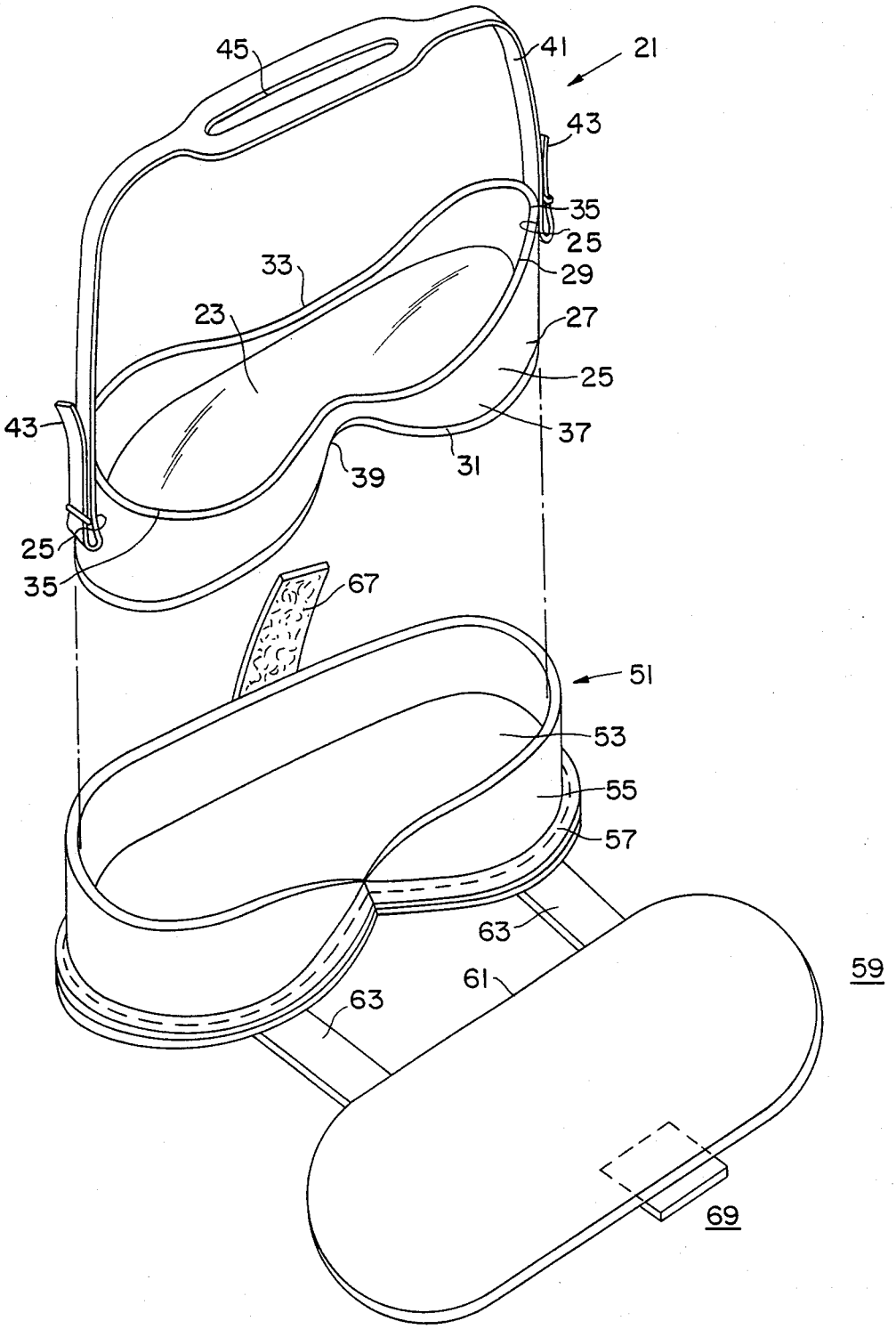
45
41
21
43
35
25
33
29
23
27
25
43
37
39
31
25
35
67
51
53
55
57
63
59
61
63
69

PROTECTIVE CASE FOR A DIVER'S FACE MASK

BACKGROUND OF THE INVENTION

1. Field of the Invention

This invention relates to a novel protective case for a diver's face mask, and particularly to a carrying case for a face mask used by scuba divers and skin divers.

2. Description of the Prior Art

Face masks are worn by scuba divers and skin divers while they are diving. Such face masks are available in a variety of designs as described; for example, *In Exploring Underwater*, J. L. Culliney, et al. (Sierra Club Books, San Francisco, Calif. 1980); *Scuba Diving*, J. Deakin (David & Charles, London, England 1981); *The Skin Divers Bible*, O. Lee (Doubleday & Co., Garden City, N.Y. 1986); and *Open Water Sport Divers Manual*, J. Jeppesen (Jeppesen, Anderson, Inc. 1984).

Generally, such face masks include a tempered glass window and a flexible frame around the periphery of the window. The window provides an air space between the diver's eyes and the water, and allows the diver to see clearly into the water in front of the window. The frame provides a water-resistant seal to the periphery of the window and also to the diver's face, usually enclosing the diver's eyes and nose, by seating on the diver's forehead, temples, cheeks and upper lip. A diver's face mask also includes an elastic strap or headband attached at each end thereof to the frame about where the frame seats on the diver's temples. The strap is adjustable in length and is divided into two (2) parts at its center portion. Since the faces of divers vary in size and shape, each diver selects a mask for optimum personal fit.

When the face mask is not being used, it is usually wrapped several times around in a towel, or other cushioning material, to prevent the glass window from being scratched or broken. The wrapped mask is then stored with other diving equipment in a carrying bag therefor. Since most of the other equipment is made of metal, or other hard materials, scratching and breaking of the glass window of the mask is a possibility, if the window is not suitably protected. A wrapped towel on the mask may become undone, permitting the window to be damaged in the carrying bag.

OBJECTS OF THE INVENTION

An object of this invention is to provide a novel protective case for a diver's face mask.

Another object is to provide a novel protective case which can protect the glass window of the diver's face mask from scratching and breakage.

Still another object is to provide a novel protective case of the type described which is light in weight and low in cost to make.

Yet another object is to provide a novel case of the type described that can be fabricated from materials that are familiar to scuba divers and skin divers.

SUMMARY OF THE INVENTION

The novel protective case is for use with a diver's face mask which includes a glass window; a pliable, flexible frame supporting the window around the periphery thereof; and a headband having the ends thereof attached to opposite sides of the frame. The novel protective case comprises:

(a) a flat base panel of foam material;

(b) a peripheral wall attached to and upstanding from a major surface of the base panel and having a contour with the base panel adapted to house said face mask without play therebetween;

(c) a flat cover panel of foam material attached on one side thereof to the peripheral wall with a pair of spaced tethers; and (d) a means for detachably attaching the other side of the cover panel to the peripheral wall of the novel case.

The base panel and cover panel are made of foam material, preferably a closed cell, sheet-like material, such as the neoprene material used to make foam diving suits. Also, it is preferred that the foam material is lined on one or both sides with a woven fabric. The foam panels spaced by the peripheral wall provide protection to the glass window of a face mask therebetween against scratching and breakage.

In addition, the base panel and peripheral wall are adapted to house the face mask, preferably with the window towards the base panel, without play between the mask and the case. This is conveniently achieved with a flexible peripheral wall which provides a yielding press-fit against the frame of the face mask.

The cover panel can close over the mask frame under the headband, which can be used as a handle to lift and lower the window and frame with the novel protective case press-fit thereon. The novel case not only protects the glass window from scratching and breakage, but is light in weight, easy to use, low in cost, and uses materials that are familiar to scuba divers and skin divers.

BRIEF DESCRIPTION OF THE DRAWINGS

The sole FIGURE is a perspective view of the preferred embodiment of the novel protective case and a typical diver's face mask ready for insertion into the protective case.

DETAILED DESCRIPTION OF THE INVENTION INCLUDING THE PREFERRED EMBODIMENT

The following description of the concepts of this invention is made in reference to the accompanying FIGURE. The sole FIGURE includes a face mask (21) comprising a tempered glass window (23) having a defined peripheral contour and a pliable rubber frame (25) having a leading edge (27) and a trailing edge (29). The leading edge (27) supports the glass window (23) along the entire periphery of the window (23). The leading edge (27) also provides a water-resistant seal to the window (23), which seal is reinforced by a peripheral metal band (31). The trailing edge (29) is contoured to provide a water-resistant fit on the diver's face with portions (33, 35, 37 & 39) that are designed to rest on the diver's forehead, temples, cheeks and upper lip, respectively. The mask includes also a headband or strap (41) having two (2) ends (43) which attach to opposite sides of the frame (25) adjacent to the temple portions (35). The headband is adjustable at both ends (43) by means well known in the art, and is divided at the center portion (45) thereof to prevent the headband (41) from slipping off the diver's head. There are many variations of the design of face masks, but all such masks include the foregoing basic parts.

The sole FIGURE also includes a preferred embodiment of a novel protective case (51) for protecting the window (23) of the mask (21) from scratching and breakage. The case (51) comprises a flat base panel (53) of foam material and a flexible peripheral wall (55) sewn with stitching (57) to the edge of the base panel (53) in such manner that it is upstanding from the base panel (53). The case (51) includes also a flat cover panel (59) of foam material attached at one side (61) thereof to the wall (55) with a pair of spaced tethers (63). The base panel (53) has the general contour of the window (23) of the mask to be housed therein, but is somewhat larger. The peripheral wall (55) also has the general contour of the window (23) and the inside surface is such as to require the mask (21) to be pressed into the peripheral wall (55).

The protective case (51) includes also means for detachably attaching the other side of the cover panel to the wall (55). As shown in the FIGURE, the attaching means comprises a hook-and-pile fastener (VELCRO) pair including a wall tab (67) sewn to the wall (55) and mating cover tab (69) sewn to the cover panel (59) other types of fasteners can be used, although VELCRO is preferred.

The base panel (53), the peripheral wall (55) and the cover panel (59) are preferably made of the neoprene flexible foam sheet material that is used to make wet suits that divers may wear when they are immersed in cold water. This sheet material may be any suitable thickness from 0.250 to 0.750 inch thick. In this embodiment, the sheet material is about 0.375 inch thick. To improve its strength and abrasion resistance, this sheet foam material may be lined on one or both of its major surfaces with a woven stretchable fabric that is adhesively attached thereto. The sheet material of the case (51) is lined on both major surfaces. Of course, other sheet foam materials may be used, but closed-cell synthetic foam materials are preferred.

The base panel (53) and the peripheral wall (55) are adapted to enclose the mask (21) therein with the glass window (23) downward toward the base panel (53) and in such manner that there is no play; that is, the mask (21) is not loose in the case (51). This is easily achieved by providing a contour that follows the general shape of the mask (21) and requiring a press fit between the mask (21) and the wall (55). Since the base panel (53) and the wall (55) are both flexible and pliable, this is easily achieved with considerable tolerance. Since the mask (21) must rub against the wall (55) as it is slid into the case (51), it is preferred that the inside surfaces of the wall (55) be lined to provide abrasion resistance.

The tethers are flat straps of fabric or solid material which may be elastic if desired. The tethers (63) are of equal lengths and are preferably the same length as, or slightly longer than, the height of the wall (55). The tethers (63) function as hinges, but provide an additional degree of freedom to the cover panel (59). With the mask in the case, the cover panel (59) may be placed over the open side of the case (21) and the fasteners (67 & 69) mated. In this closed arrangement, the headband (41) extends above the cover panel (59) and can be used as a handle to lift the entire assembly. Since the mask is press fit into the case, the case (51) remains on the mask frame (25) by friction when the assembly is lifted by the headband (41).

The novel protective case may be fabricated by joining the base panel (53), the peripheral wall (55), the tethers (63) and the fasteners (67 & 69) as shown by sewing as described above, or with adhesive, or partly by sewing and partly with adhesive, or with both sewing and adhesive.

The foregoing FIGURE and descriptions thereof are provided as illustrative as some of the preferred embodiments of the concepts of this invention. While these embodiments represents what is regarded as the best modes for practicing this invention, they are not intended as delineating the scope of the invention which is set forth in the following claims.

What is claimed is:

1. A protective case for a diver's face mask, said face mask comprising a glass window; a pliable, flexible frame supporting said window around the periphery thereof; and a headband having the ends thereof attached to opposite sides of said frame, said protective case comprising:

(a) a flat base panel of foam material;

(b) a flexible peripheral wall attached to and upstanding from a major surface and having a contour with said panel adapted to house said face mask therein without play therebetween;

(c) a flat cover panel of foam material attached on one side thereof to said wall with a pair of spaced tethers; and (d) means for detachably attaching the other side of said cover panel to said wall.

2. The protective case defined in claim 1 wherein said base panel, said cover panel, and said wall are each made of a sheet-like, closed-cell, foam material.

3. The protective case defined in claim 2 wherein at least one major surface of said sheet-like pliable, flexible material has a woven fabric liner attached thereto.

4. The protective case defined in claim 2 wherein said contour of said wall is adapted so as to press fit said face mask in said case.

5. The protective case defined in claim 1 wherein said tethers are attached to said base panel and each tether has a length between said base and said cover panel equal to or slightly larger than the maximum height of said wall.

6. A protective case for a diver's face mask, said face mask comprising a substantially flat tempered glass window having a defined peripheral window contour, a pliable, flexible frame providing a water-resistant seal to and supporting said window entirely around said window periphery, and an elastic headband having the ends thereof adjustably attached to said frame, said protective case comprising:

(a) a flat base panel of foam material, said panel having opposed major surfaces and the general peripheral contour of said window, said base panel being larger than said window;

(b) a wall attached to and upstanding from a major surface of said base panel along the edges thereof, said base panel and said wall being adapted to have said face mask therein without play therebetween;

(c) a flat cover panel of foam material having opposed major surfaces and a pair of opposite sides, said cover panel being attached along one of said sides to said wall with a pair of spaced tethers of substantially equal length; and (d) attachment means for detachably attaching said other side of said cover panel to said wall.

7. The protective case defined in claim 6 wherein said base panel, said cover panel, and said wall are each made of neoprene closed-cell foam sheet material.

8. The protective case defined in claim 7 wherein both major surfaces of said sheet material have a woven synthetic liner attached thereto.

9. The protective case defined in claim 8 wherein said base panel and said wall are contoured to have said face mask therein with a press fit therebetween.

10. The protective cased defined in claim 9 wherein said foam sheet material is about 0.375 inch thick and said attachment means is a hook-and-pile fastener pair attached to said wall and said cover panel in mating fashion.

* * * * *